US006865439B1

(12) United States Patent
Tu

(10) Patent No.: US 6,865,439 B1
(45) Date of Patent: Mar. 8, 2005

(54) COMPUTER-ASSISTED METHOD AND SYSTEM FOR MAKING A PATTERNED TEXTILE ARTICLE SIMULATING A FABRIC SAMPLE HAVING A PARTICULAR PATTERN

(75) Inventor: Chung-Hsing Tu, Tainan Hsien (TW)

(73) Assignee: Mean Time Enterprise Co., Ltd., Tainan Hsien (TW)

( * ) Notice: Subject to any disclaimer, the term of this patent is extended or adjusted under 35 U.S.C. 154(b) by 0 days.

(21) Appl. No.: 10/867,639

(22) Filed: Jun. 16, 2004

(51) Int. Cl.[7] ..... G06F 19/00
(52) U.S. Cl. ..... 700/131; 700/139
(58) Field of Search ..... 700/131, 139; 57/1 R, 282

(56) References Cited

U.S. PATENT DOCUMENTS 3,998,041 A * 12/1976 Graf et al. ..... 57/337
5,016,183 A * 5/1991 Shyong ..... 700/131

* cited by examiner

*Primary Examiner*—Peter Nerbun
(74) *Attorney, Agent, or Firm*—Hunton & Williams LLP

(57) ABSTRACT

A computer-assisted method for making a patterned textile article simulating a fabric sample having a particular pattern includes the steps of: storing a set of two-dimensional image data of the sample; selecting a textured yarn to form the textile article, the textured yarn being changeable in texture to define the pattern; reading the image data along a direction corresponding to orientation of the yarn designed for the textile article, and determining the position of the pattern in the fabric sample; generating a set of one-dimensional linear data from the two-dimensional image data; storing yarn texture control data representative of parameters of the texturing of the yarn in a yarn fabricating device; fabricating the yarn by controlling the yarn fabricating device; and forming the patterned textile article using the fabricated yarn.

10 Claims, 11 Drawing Sheets

| set# | rotation direction | | drawing ratio | | yarn feeding ratio | | distance (cm) | | twist | speed increasing time | |
|---|---|---|---|---|---|---|---|---|---|---|---|
| | Min | Max | Min | Max | Min | Max | Min | Max | | | |
| 1 | positive(+) | positive(+) | 20 | 20 | 1 | 1 | 12120 | 12120 | 350 | | 0 |
| 2 | positive(+) | positive(+) | 20 | 20 | 2.2 | 2.2 | 374 | 374 | 350 | | 0 |
| 3 | positive(+) | positive(+) | 20 | 20 | 1 | 1 | 240 | 240 | 350 | | 0 |
| 4 | positive(+) | positive(+) | 20 | 20 | 2.2 | 2.2 | 374 | 374 | 350 | | 0 |
| 5 | positive(+) | positive(+) | 20 | 20 | 1 | 1 | 240 | 240 | 350 | | 0 |
| 6 | positive(+) | positive(+) | 20 | 20 | 2.2 | 2.2 | 374 | 374 | 350 | | 0 |
| 7 | positive(+) | positive(+) | 20 | 20 | 1 | 1 | 240 | 240 | 350 | | 0 |
| 8 | positive(+) | positive(+) | 20 | 20 | 2.2 | 2.2 | 374 | 374 | 350 | | 0 |
| 9 | positive(+) | positive(+) | 20 | 20 | 1 | 1 | 240 | 240 | 350 | | 0 |
| 10 | positive(+) | positive(+) | 20 | 20 | 2.2 | 2.2 | 374 | 374 | 350 | | 0 |
| 11 | positive(+) | positive(+) | 20 | 20 | 1 | 1 | 240 | 240 | 350 | | 0 |
| 12 | positive(+) | positive(+) | 20 | 20 | 2.2 | 2.2 | 374 | 374 | 350 | | 0 |
| 13 | positive(+) | positive(+) | 20 | 20 | 1 | 1 | 240 | 240 | 350 | | 0 |
| 14 | positive(+) | positive(+) | 20 | 20 | 2.2 | 2.2 | 374 | 374 | 350 | | 0 |
| 15 | positive(+) | positive(+) | 20 | 20 | 1 | 1 | 240 | 240 | 350 | | 0 |
| 16 | positive(+) | positive(+) | 20 | 20 | 2.2 | 2.2 | 374 | 374 | 350 | | 0 |
| 17 | positive(+) | positive(+) | 20 | 20 | 1 | 1 | 240 | 240 | 350 | | 0 |

FIG. 9A

| set# | rotation direction | | drawing ratio | | yarn feeding ratio | | distance (cm) | | twist | speed increasing time | |
|---|---|---|---|---|---|---|---|---|---|---|---|
| | Min | Max | Min | Max | Min | Max | Min | Max | | | |
| 103 | positive(+) | positive(+) | 20 | 20 | 1 | 1 | 240 | 240 | 350 | | 0 |
| 104 | positive(+) | positive(+) | 20 | 20 | 2.2 | 2.2 | 374 | 374 | 350 | | 0 |
| 105 | positive(+) | positive(+) | 20 | 20 | 1 | 1 | 240 | 240 | 350 | | 0 |
| 106 | positive(+) | positive(+) | 20 | 20 | 2.2 | 2.2 | 374 | 374 | 350 | | 0 |
| 107 | positive(+) | positive(+) | 20 | 20 | 1 | 1 | 240 | 240 | 350 | | 0 |
| 108 | positive(+) | positive(+) | 20 | 20 | 2.2 | 2.2 | 374 | 374 | 350 | | 0 |
| 109 | positive(+) | positive(+) | 20 | 20 | 1 | 1 | 240 | 240 | 350 | | 0 |
| 110 | positive(+) | positive(+) | 20 | 20 | 2.2 | 2.2 | 374 | 374 | 350 | | 0 |
| 111 | positive(+) | positive(+) | 20 | 20 | 1 | 1 | 240 | 240 | 350 | | 0 |
| 112 | positive(+) | positive(+) | 20 | 20 | 2.2 | 2.2 | 374 | 374 | 350 | | 0 |
| 113 | positive(+) | positive(+) | 20 | 20 | 1 | 1 | 240 | 240 | 350 | | 0 |
| 114 | positive(+) | positive(+) | 20 | 20 | 2.2 | 2.2 | 374 | 374 | 350 | | 0 |
| 115 | positive(+) | positive(+) | 20 | 20 | 1 | 1 | 240 | 240 | 350 | | 0 |
| 116 | positive(+) | positive(+) | 20 | 20 | 2.2 | 2.2 | 374 | 374 | 350 | | 0 |
| 117 | positive(+) | positive(+) | 20 | 20 | 1 | 1 | 240 | 240 | 350 | | 0 |
| 118 | positive(+) | positive(+) | 20 | 20 | 2.2 | 2.2 | 374 | 374 | 350 | | 0 |

FIG. 9B

COMPUTER-ASSISTED METHOD AND SYSTEM FOR MAKING A PATTERNED TEXTILE ARTICLE SIMULATING A FABRIC SAMPLE HAVING A PARTICULAR PATTERN

BACKGROUND OF THE INVENTION

1. Field of the Invention

The invention relates to a computer-assisted method for making a patterned textile article, more particularly to a computer-assisted method for making a patterned textile article simulating a fabric sample having a particular pattern. The invention also relates to a computer-assisted system for making the patterned textile article.

2. Description of the Related Art

Embroidering, transfer printing, adhering, and the like are conventional methods employed to form a predetermined pattern on a fabric useful for producing clothes, hand bags, hats, and others so as to impart an attractive appearance to the products made from the fabric. Another conventional method employed to form a pattern on a fabric is a jacquard weaving or knitting method. The embroidering method is essentially a two-stage method in which a plain fabric is first provided, which is then embroidered to form the predetermined pattern thereon. The transfer printing and adhering methods are similarly two-stage methods. The jacquard weaving or knitting method is a method in which yarns having different colors are woven or knitted simultaneously in a two-layered manner. As a result, the fabric made thereby is relatively thick.

SUMMARY OF THE INVENTION

Therefore, the object of the present invention is to provide a computer-assisted method for making a patterned textile article simulating a fabric sample having a particular pattern, by which method the patterned textile article can be made using a single textured yarn.

According to one aspect of this invention, a computer-assisted method for making a patterned textile article simulating a fabric sample having a particular pattern includes the steps of:

- storing a set of two-dimensional image data of the fabric sample;
- selecting a textured yarn to form the textile article, the textured yarn being changeable from one texture to another texture to define the pattern;
- reading the image data along a direction corresponding to orientation of the yarn designed for the textile article, and determining the position of the pattern in the fabric sample;
- generating a set of one-dimensional linear data from the two-dimensional image data, the linear data representing distances and lengths on the yarn and including position data defining the positions of the textures on the yarn;
- storing yarn texture control data representative of parameters of the texturing of the yarn in a yarn fabricating device;
- fabricating the yarn by controlling the yarn fabricating device to change the texture of the yarn according to the position data and the yarn texture control data; and
- forming the patterned textile article using the fabricated yarn.

According to another aspect of this invention, a computer-assisted system for making a patterned textile article simulating a fabric sample having a particular pattern and formed from a textured yarn includes image data storage means, scanning means, linear data generating means, yarn texture control data storage means, a yarn fabricating device, and a fabric forming device. The textured yarn is capable of changing from one texture to another texture along a length thereof to define the pattern. The image data storage means stores image data of the fabric sample. The scanning means scans the image data along a direction corresponding to orientation of the yarn designed for the textile article, and determines the position of the pattern in the fabric sample. The linear data generating means generates a set of one-dimensional linear data from the two-dimensional image data. The linear data represents distances and lengths on the yarn, and includes position data defining the positions of the textures on the yarn. The yarn texture control data storage means stores yarn texture control data representative of different sets of parameters of the texturing of the yarn in a yarn fabrication device. The yarn fabricating device is used to fabricate the yarn and to change the texture of the yarn according to the position data and the yarn texture control data. The fabric forming device forms the patterned textile article using the yarn fabricated by the yarn fabrication device.

BRIEF DESCRIPTION OF THE DRAWINGS

Other features and advantages of the present invention will become apparent in the following detailed description of the preferred embodiment with reference to the accompanying drawings, of which:

FIGS. 6, 7, 8, and 9 illustrate graphical user interfaces showing data useful in the preferred embodiment.

DETAILED DESCRIPTION OF THE PREFERRED EMBODIMENT

The present invention is aimed at providing a fabric article with a pattern, particularly a stereo pattern, which is formed from a textured yarn, such as a fancy yarn having protuberances or loops, without the need for an additional embroidering process. To form a patterned fabric article corresponding to a user's design, it should be ensured that the textures, such as protuberances or loops, are formed at proper positions of a yarn so that the textures can provide a pattern simulating that of the user's design. Typically, the texturing of a yarn is controlled by the parameters of a yarn fabricating or texturing device and/or process. The parameters controlling the texturing of the yarn will be described by way of example as follows.

Figure 1:
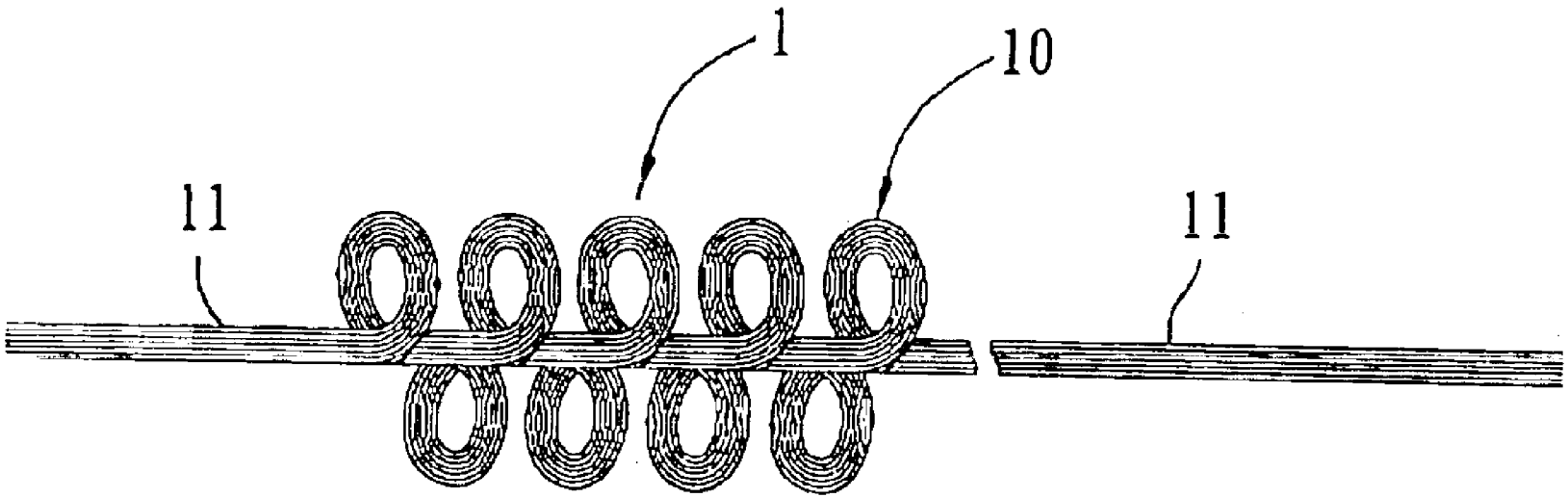
FIG. 1 is a fragmentary schematic view of a textured yarn used in the preferred embodiment of a computer-assisted method for making a patterned textile article according to this invention.
Figure 2:
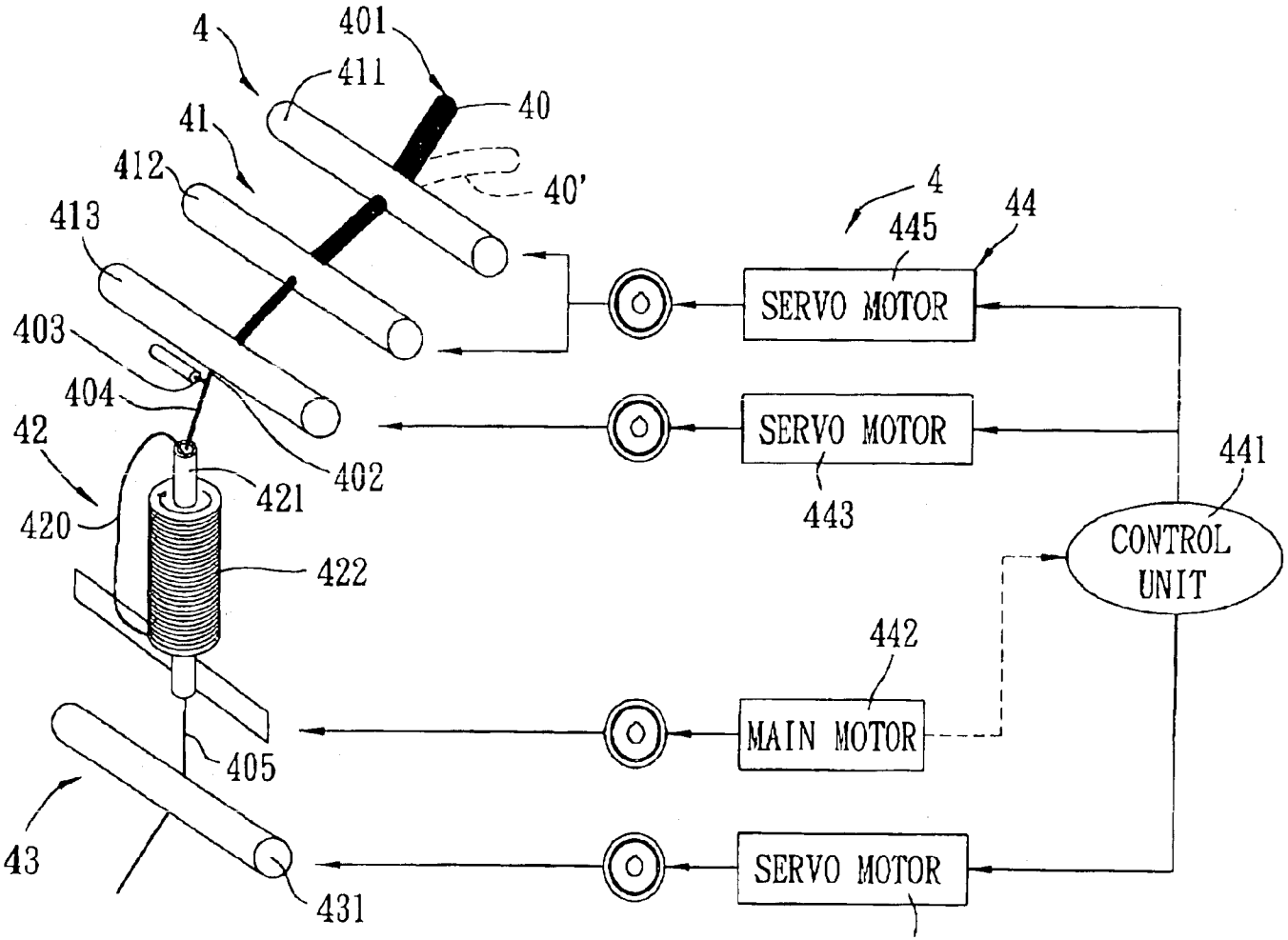
FIG. 2 is a schematic view of a yarn fabricating device used in the preferred embodiment.

An example of the fancy yarn 1 is shown in FIG. 1 to include loops 10 and loop-free portions 11. The loops 10 and loop-free portions 11 alternate along the length of the yarn. FIG. 2 schematically shows a conventional yarn fabricating device 4 for texturing the fancy yarn 1. As shown in FIG. 2, the device 4 includes, sequentially along a forward direction of a yarn 40, a feeding roller mechanism 41, a yarn twisting mechanism 42, a delivery roller mechanism 43, and a control mechanism 44.

The feeding roller mechanism 41 includes a rear roller 411, a middle roller 412, and a front roller 413 sequentially. The initial segment 401 of the yarn 40 has a coarse configuration, and is drawn between the rear roller 411 and the middle roller 412, and then between the middle roller 412 and the front roller 413 by virtue of the revolution speed differences between the rear roller 411 and the middle roller 412, and between the middle roller 412 and the front roller 413 so that the initial segment 401 is drawn to form an effect yarn 402 having a required fineness. A core yarn 403 is fed while the yarn 40 reaches the stage of the effect yarn 402 so as to form a combined yarn 404 composed of the core yarn 403 and the effect yarn 402.

The yarn twisting mechanism 42 includes a hollow spindle 421 rotating along an axis, and a binding cone 422 rotating around the hollow spindle 421. The combined yarn 404 is fed together with a binding yarn 420 wound around the binding cone 422 into the hollow spindle 421 to conduct a twisting action by winding the binding yarn 420 onto the combined yarn 404 so as to make the fancy yarn 405.

The delivery roller mechanism 43 includes a pressing roller 431 mounted below the yarn twisting mechanism 42 for delivering the fancy yarn 405 from the hollow spindle 421. The degree of twist of the fancy yarn 405 can be regulated by changing the ratio of the revolution speed of the hollow spindle 421 to that of the pressing roller 431. A yarn feeding ratio is defined by a ratio of the revolution speed of the front roller 413 to that of the pressing roller 431, and can be regulated by the revolution speed difference between the front roller 413 and the pressing roller 431 so as to form the fancy yarn 405 with a desired loop or protuberance structure.

The control mechanism 44 includes a control unit 441, a main motor 442 electrically connected to the control unit 441, and first, second, and third servo motors 443,444,445 independently controlled by the control unit 441. The control unit 441. Is of a computer control type programmed to control and to regulate the output powers of the main motor 442, and the first, second, and third servo motors 443,444, 445 independently, and in turn to control the revolution speeds of the hollow spindle 421, the rear, middle and front rollers 441,442,443, and the pressing roller 431. The parameters such the drawing ratio, the yarn feeding ratio and the degree of twist can be regulated so as to vary the fineness, the bulking intensity, and the loop size of the fancy yarn so-produced.

Figure 3:
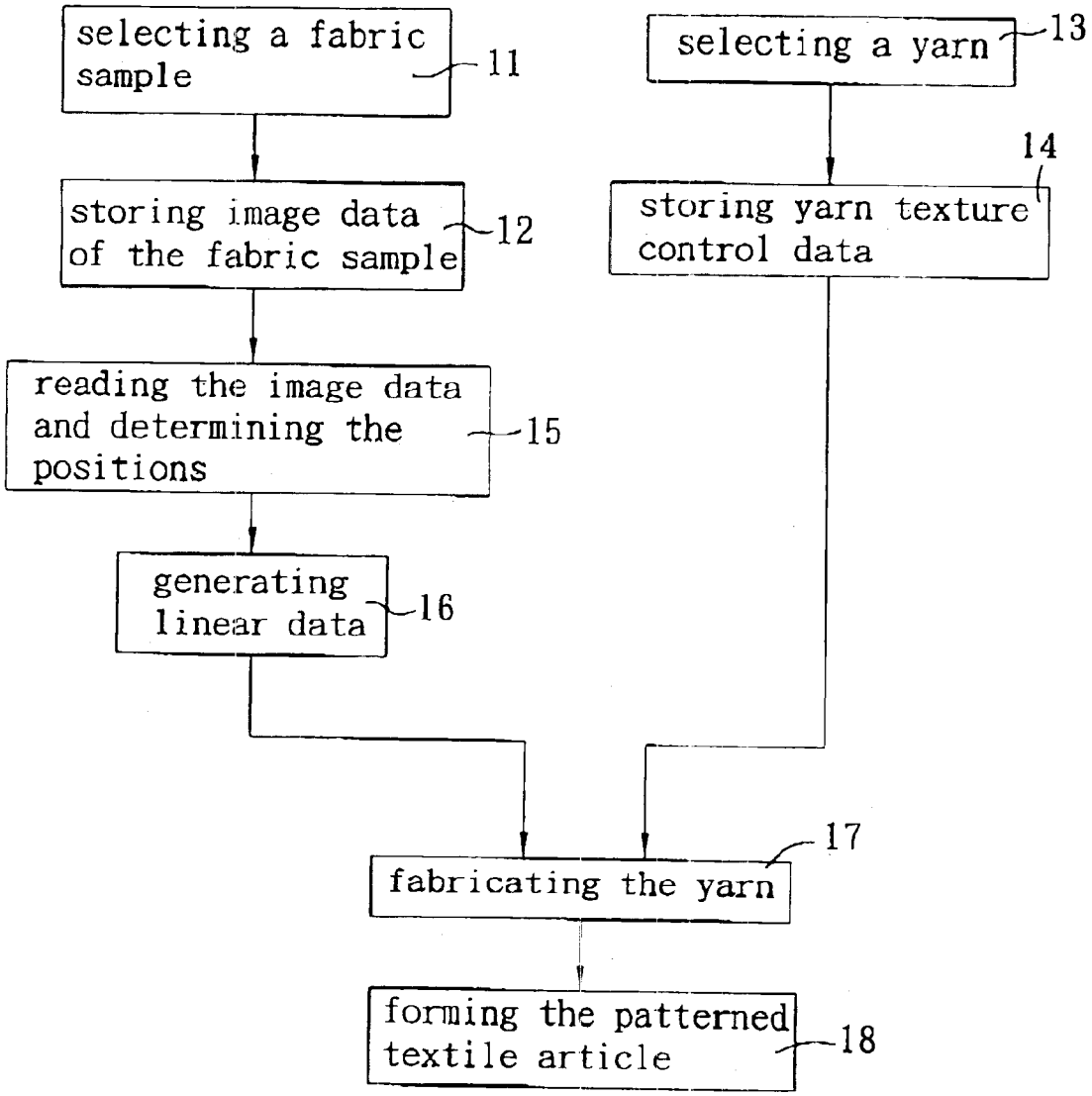
FIG. 3 is a flow diagram of the preferred embodiment of the method according to this invention.

Referring to FIG. 3, the preferred embodiment of a computer-assisted method for making a patterned textile article according to this invention is shown to include: (11) selecting a fabric sample; (12) storing two-dimensional image data of the fabric sample; (13) selecting a yarn having desired properties; (14) storing yarn texture control data; (15) reading the image data and determining the position of the pattern in the fabric sample; (16) generating linear data; (17) fabricating the yarn; and (18) forming the patterned textile article. The method of the preferred embodiment may be conducted by using a computed-assisted system illustrated in FIG. 4.

Figure 4:
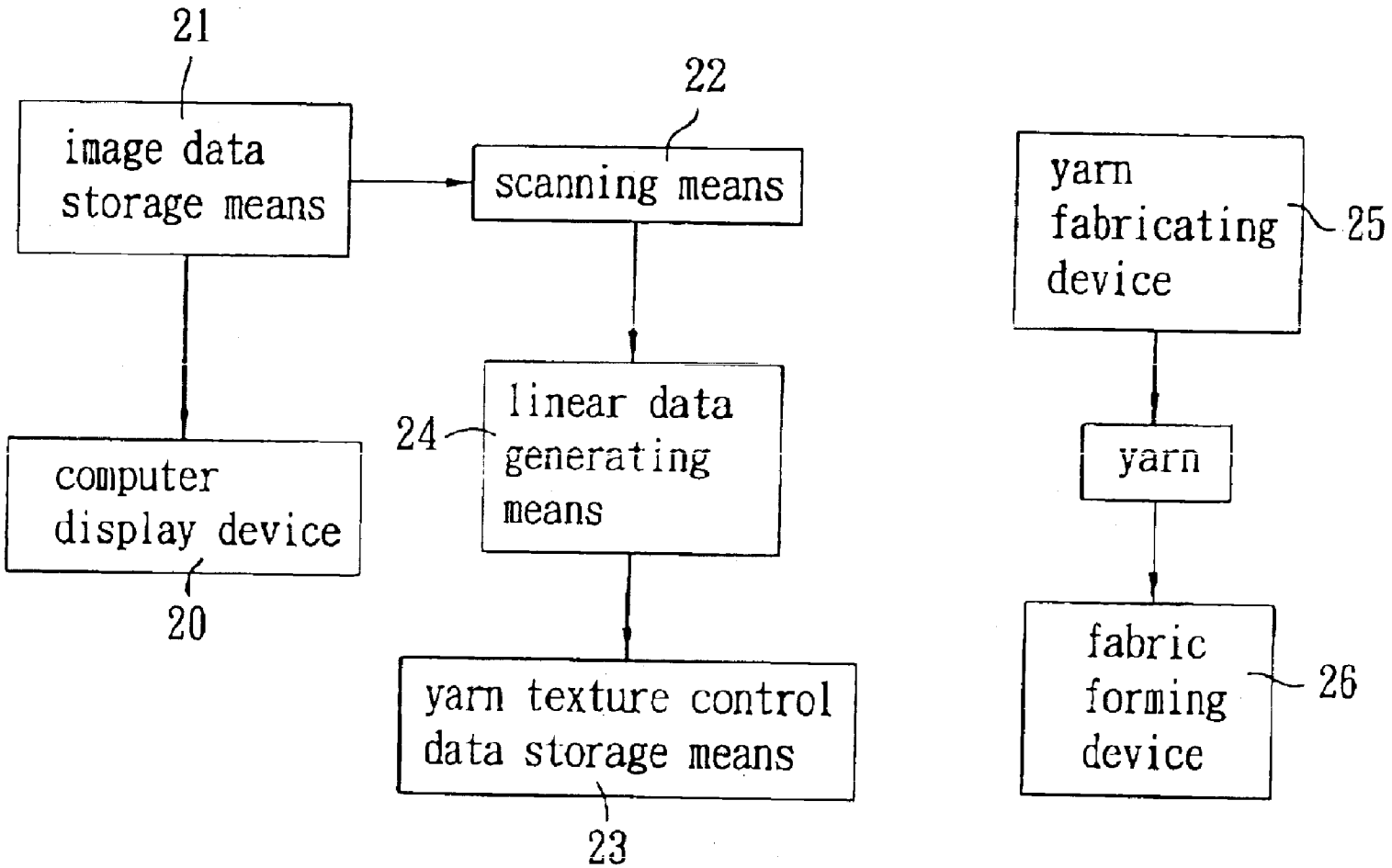
FIG. 4 is a block diagram of the preferred embodiment of a computer-assisted system for making a patterned textile article according to this invention.

As shown in FIG. 4., the computer-assisted system includes a computer display device 20, image data storage means 21, scanning means 22, linear data generating means 24, yarn texture control data storage means 23, a yarn fabricating device 25, and a fabric forming device 26.

Figure 5:
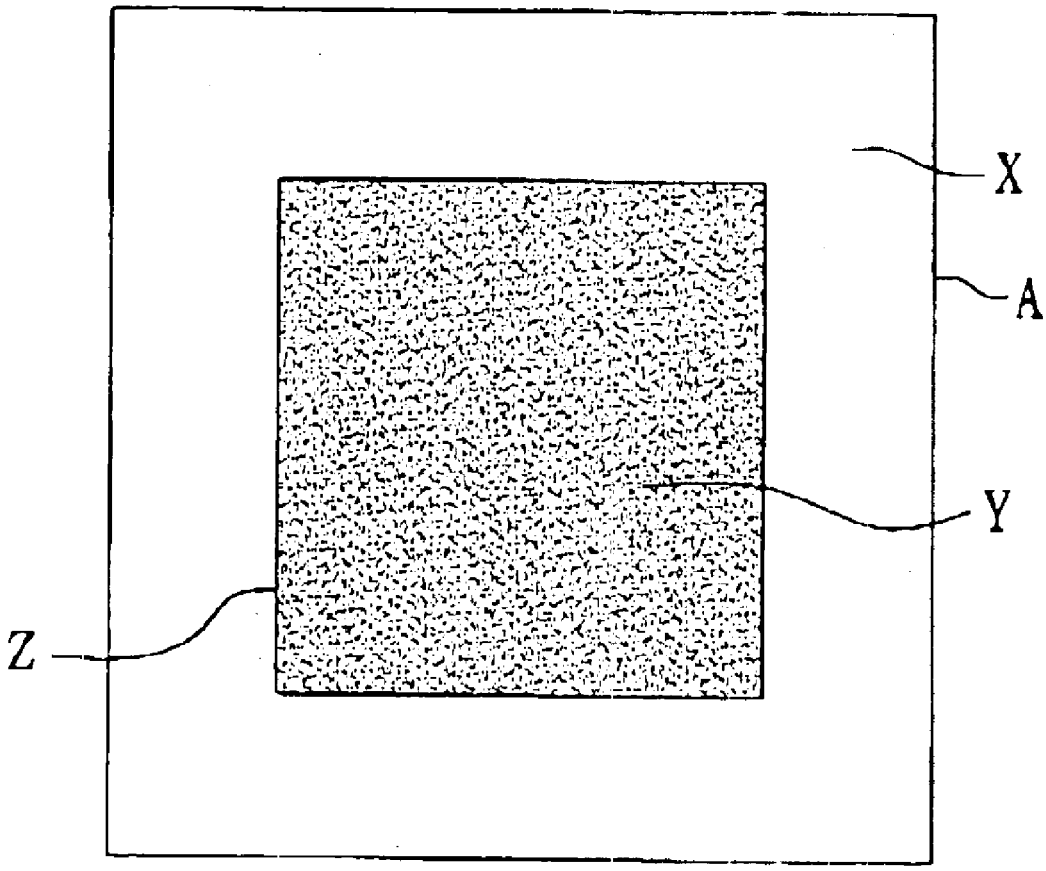
FIG. 5 is a schematic view of a fabric sample to be simulated by the patterned textile article made by the preferred embodiment of the method according to this invention.

In step (11) of the computer-assisted method, a fabric sample having a two-dimensional shape and a desired pattern is selected for use as a reference for designing and producing the patterned textile article. The fabric sample may be an existing fabric or a newly designed fabric. The selected fabric sample may be one which is shown at (A) in FIG. 5 and includes a rectangular basic texture region (X) and a pattern (Y) formed in the basic texture region (X).

Figure 6:
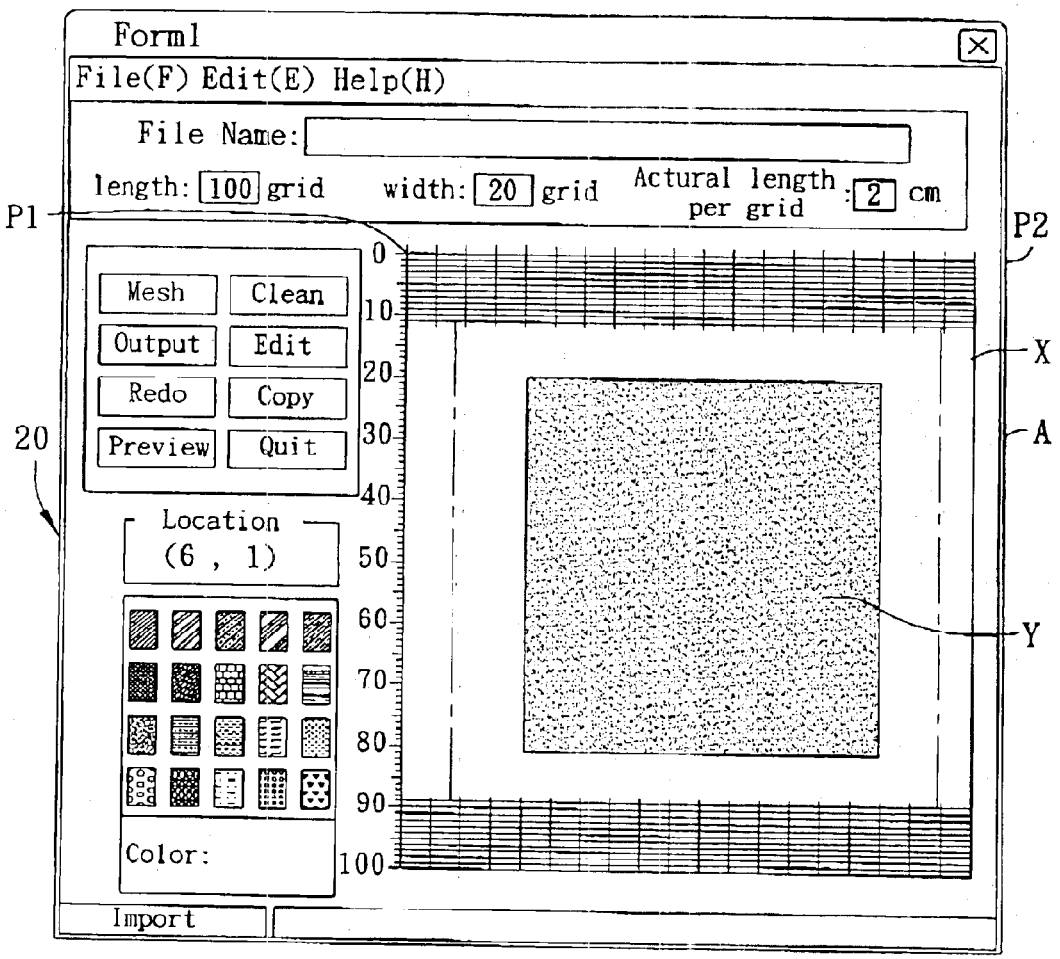

In step (12), a set of two-dimensional image data is produced from the fabric sample (A) and stored in the image data storage means 21. As shown in FIG. 6, the image data are transformed into an image displayed on a computer display device 20.

In step (13), a yarn is selected for making the, patterned textile article, which simulates the fabric sample (A). The selected yarn is a textured yarn which can be changed from one texture to another texture by varying the parameters of the texturing of the yarn in a yarn fabricating process. With different yarn textures formed along the yarn, patterns can be formed in a knitted or woven fabric which is produced from the yarn. In this embodiment, the pattern (Y) of the fabric sample (A) is formed by locating different yarn textures at suitable positions of the yarn. For example, when the selected yarn is the fancy yarn 1 which has the loops 10 and the loop-free portions 11 as shown in FIG. 1, the loop-free portions 11 of the fancy yarn will define the basic texture region (X), whereas the loops 10 will define the pattern (Y). As described hereinbefore, the formation of the loops 10 and loop-free portions 11 is controlled by the parameters, such as, drawing ratio, yarn feeding ratio, the degree of twist, speed increasing or decreasing periods, take-up ratio, etc.

In step (14), after the yarn is selected, yarn texture control data representative of the parameters of the texturing of the yarn are produced and stored in the yarn texture control data storage means 23. For example, the entire image of the fabric sample (A) shown in FIG. 6 includes a matrix of units which are defined in both length wise and width wise directions. Each unit represents a rectangle. The basic texture region (X) and the pattern (Y) are colored differently with two colors, such as black for the region (X) and red for the pattern (Y). Therefore, the units in the basic texture region (X) are black, whereas the units in the pattern (Y) are red.

Figure 7:
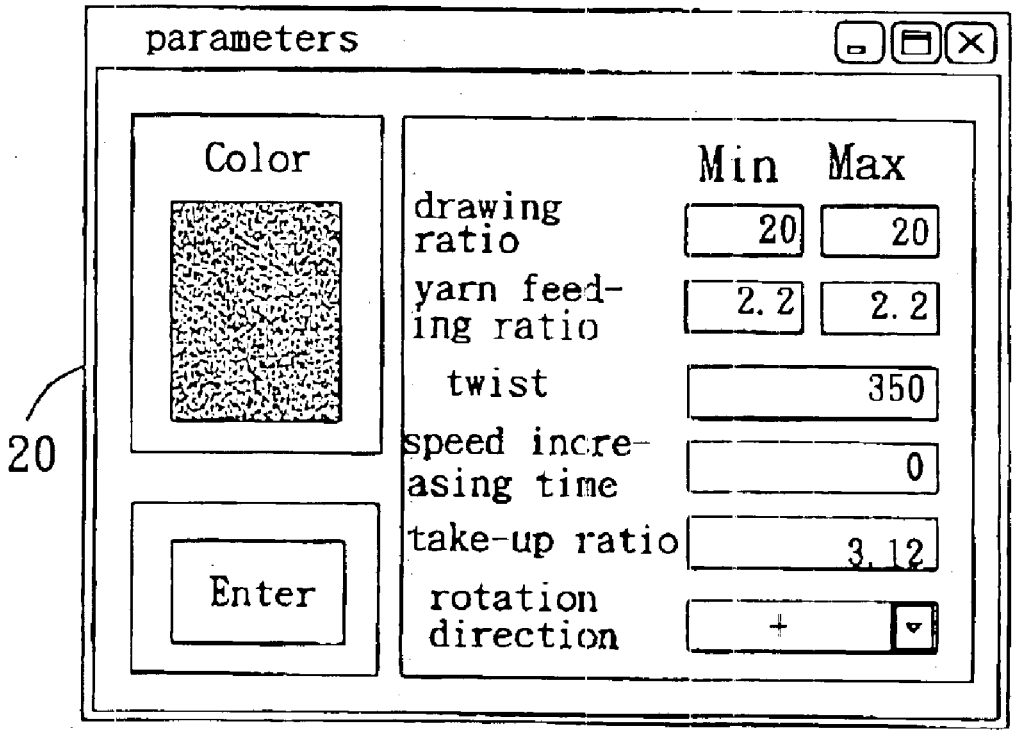
Figure 8:
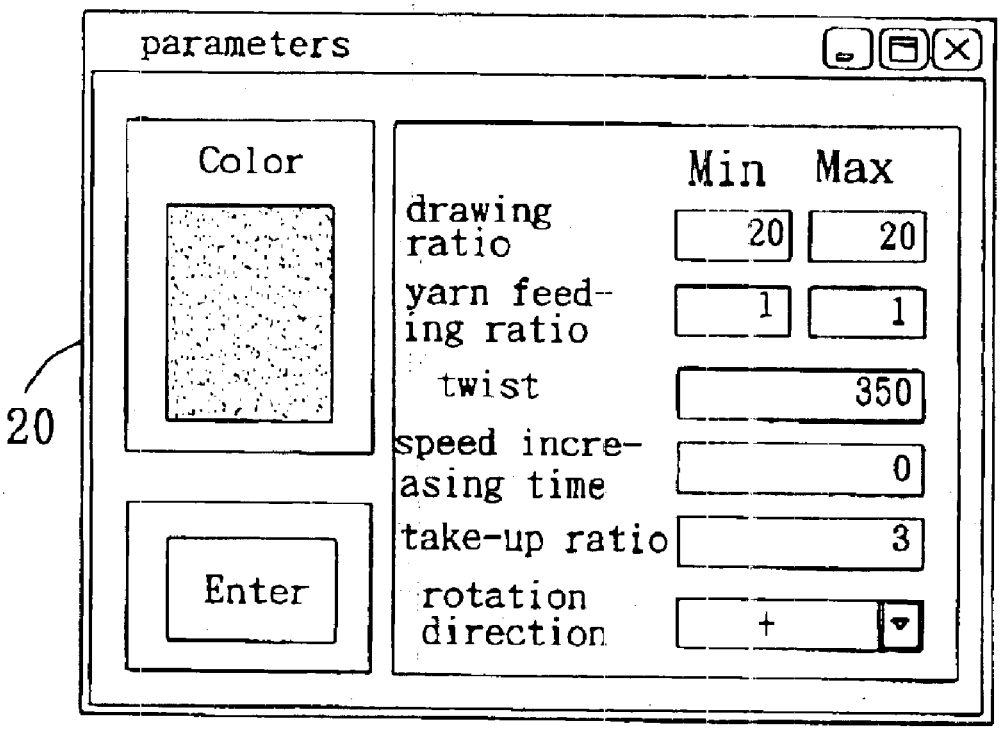

Referring to FIGS. 7 and 8, yarn texture control data or parameters for red and black units stored in the yarn texture control data storage means 23 are displayed on the computer display device 20. The yarn texture control data or parameters for the red units are set as follows: 20 for drawing ratio; 2.2 for yarn feeding ratio; 350 for the twist, 0 for speed increasing time, 3.12 for take-up ratio, and positive direction for rotation direction. According to the yarn texture control data displayed in FIG. 7, loops 10 can be formed in the fancy yarn 1.

The yarn texture control data or parameters for the black units are set as follows: 20 for drawing ratio; 1 for yarn feeding ratio; 350 for the twist, 0 for speed increasing time, 3 for take-up ratio, and positive direction for rotating direction. According to the yarn texture control data displayed in FIG. 8, the loop-free portions 11 can be formed in the fancy yarn 1.

Of course, the fancy yarn as selected may have more than two textures, for example, three different textures. In this case, the image shown on the computer display device 20 will have three different colors, and the matrix of the image will have its units specified with three colors. The three colors will represent three different sets of yarn texture control data. The units with the same colors will have the same yarn texture control data.

In step (15), the image data are read along a direction corresponding to orientation of the yarn designed for the textile article, and the position of the pattern (Y) in the image are determined by the scanning means 22 (see FIG. 4). In step (16), a set of one-dimensional linear data is generated from the two-dimensional image data of the fabric sample (A). Referring again to FIG. 6, in the matrix of the image data, the matrix units defined from point P1 to point P2 represent a course. The scanning means 22 scans the units in the first course from the left to the right, and then scans the units in the second course from the right to the left and so on until the hundredth course is finished. In other words, the scanning means 22 scans the matrix units along rows successively and sequentially. The direction of the scanning line of the scanning means 22 represents the direction of the length of the yarn so that the length of each course and the total length of the courses included in the matrix can be determined. Linear data can therefore be generated.

For example, the matrix includes 100×20 units. 100 units are built in a lengthwise direction (the direction of columns), and 20 units are built in a widthwise direction (the direction of rows). Supposing each unit in the widthwise direction has a length of 2 cm, the width of the fabric sample (A) is 40 cm (20×2). The length of the yarn required in each course is calculated to be 40 cm×3(take-up ratio)=120 cm. Due to the presence of the pattern (Y), from the twentieth course to the eightieth course, the length of the yarn required in each course is 8 (unit)×2 (unit width)×3(take-up ratio)+12 (unit)×2 (unit width)×3.12(take-up ratio)=122.88 cm. The sum of the lengths of the yarn required throughout the courses is a total length of the yarn required to make the textile article that simulates the fabric sample (A).

If a plurality of the textile articles are to be made, the aforesaid total length of the yarn must be multiplied so that the yarn has a plurality of operative yarn sections each having the aforesaid total length. These operative yarn sections must be spaced apart by interposing waste yarn sections therebetween for identification purposes.

As described hereinbefore, the basic texture region (X) and the pattern (Y) in the image of the fabric sample (A) are provided with different colors. Due to the different colors when the image is scanned by the scanning means 22, the positions of the matrix units in the region of the pattern (Y) and in the basic texture region (X) are detected and determined. Since the matrix units are scanned by the scanning means 22 along the direction of the courses of the matrix units which represent the direction of the length of the yarn, the information detected by the scanning means 22 is composed of linear data which indicate distances and lengths of the yarn. To form the pattern (Y), the yarn must have one texture at positions represented by the matrix units within the region of the pattern (Y), and another different texture at other positions represented by the matrix units within the basic texture region (X). The positions of the different textures are represented by position data which indicate distances on the yarn from a reference point, for instance, a starting point of the yarn.

In step (17), the selected yarn as mentioned hereinbefore is fabricated by a yarn fabricating device 25 (see FIG. 4) through a control program using the aforesaid linear data and yarn texture control data. Based on the linear data and the yarn texture control data generated, the yarn fabricating device 25 can be controlled to change the texture of the yarn 1 at predetermined positions and to form each texture within a predetermined length.

Referring again to FIG. 2, the yarn is fabricated by the yarn fabricating device 4 with the aid of the control unit 441 programmed from the aforesaid yarn texture control data and linear data including the position data. As shown in FIGS. 7 and 8, the two sets of the parameters differ in the yarn feeding ratio. Specifically, the yarn feeding ratio is 2.2 in FIGS. 7 and 1 is FIG. 8. During the fabrication of the yarn, according to these parameters, the control unit 441 instructs the yarn fabricating device 4 to change the yarn feeding ratio whenever the yarn 40 fed to the yarn fabricating device 4 reaches the distance indicated by the position data generated from the image data.

Referring again to FIG. 6, in combination with FIG. 2, during the fabrication of the fancy yarn 1, since the total length of the yarn required for forming the textile article has been determined by scanning the units of the matrix from the first course to the hundredth course, after a section of the yarn 40 which has this total length is fed into and textured by the yarn fabricating device 4, an additional section of the yarn 40 equal to this total length may be fed continuously into the yarn fabricating device 4 for making an additional piece of the textile article. In order to identify the former and latter sections of the yarn, a waste yarn section may be interposed between the two sections. This waste yarn section will be discarded after the fabrication of the textile articles.

In step (18), the yarn produced in the step (17) is used to form the patterned textile article by means of the fabric forming device 26 (see FIG. 4). Due to the yarn whose texture was controlled as described hereinbefore, the resulting textile article has a pattern which simulates that of the fabric sample (A). The fabric forming device 26 may be a known weaving or knitting machine.

Referring to FIG. 9, a plurality of yarn texture control data sets and position data for controlling the texturing of the yarn in the yarn fabricating device 4 are provided as an example. These data are programmed to control the yarn fabricating device 4 for forming another patterned textile article.

Figure 10:
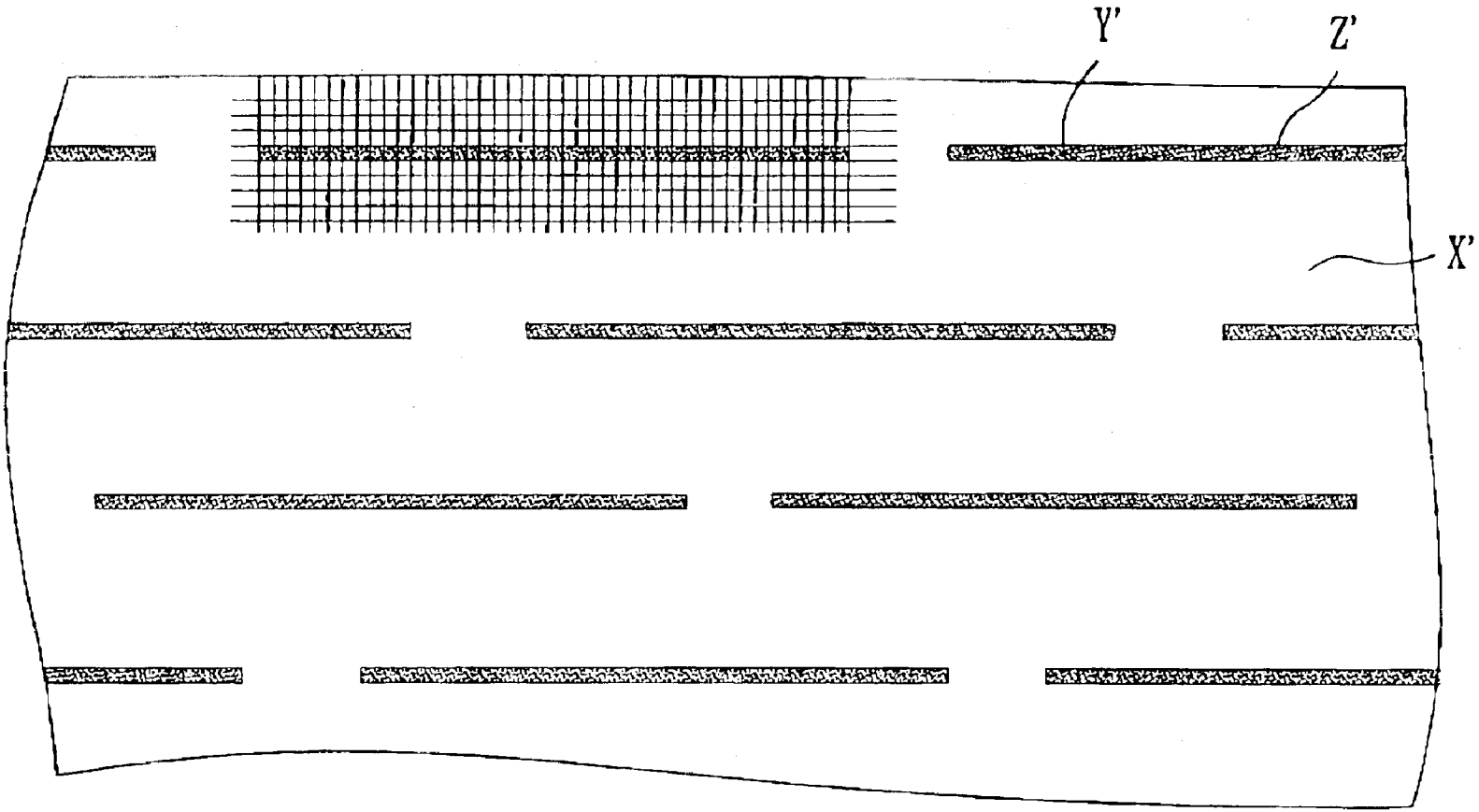
FIG. 10 is a fragmentary schematic view of another patterned textile article made by the preferred embodiment of the method according to this invention.

Referring to FIG. 10, another fabric sample is shown as being a gypsy style with stripe patterns (Y'), stripe-free parts (X') and boundary edges (Z'). A patterned textile article which simulates this fabric sample may also be produced according to the computer-assisted method and system of the present invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A computer-assisted method for making a patterned textile article simulating a fabric sample having a particular pattern, comprising the steps of:

storing a set of two-dimensional image data of the fabric sample;

selecting a textured yarn to form the textile article, the textured yarn being changeable from one texture to another texture to define the pattern;

reading the image data along a direction corresponding to orientation of the yarn designed for the textile article, and determining the position of the pattern in the fabric sample;

generating a set of one-dimensional linear data from the two-dimensional image data, the linear data representing distances and lengths on the yarn and including position data defining the positions of the textures on the yarn;

storing yarn texture control data representative of parameters of the texturing of the yarn in a yarn fabricating device;

fabricating the yarn by controlling the yarn fabricating device to change the texture of the yarn according to the position data and the yarn texture control data; and forming the patterned textile article using the fabricated yarn.

2. The computer-assisted method as claimed in claim 1, further comprising a step of displaying the image data of the fabric sample on a computer display device.

3. The computer-assisted method as claimed in claim 1, wherein the image data include a matrix of units, the units being scanned along rows successively and sequentially to generate the linear data.

4. The computer-assisted method as claimed in claim 1, wherein the fabricated yarn is formed with a plurality of operative yarn sections, each of which has a length sufficient for forming the patterned textile article, and waste yarn sections interposed between said operative yarn sections.

5. The computer-assisted method as claimed in claim 1, wherein the yarn is a fancy yarn.

6. A computer-assisted system for making a patterned textile article which simulates a fabric sample having a particular pattern and which is formed from a textured yarn that is capable of changing from one texture to another texture along a length thereof to define the pattern, said computer-assisted system comprising:

image data storage means for storing image data of the fabric sample;

scanning means for scanning the image data along a direction corresponding to orientation of the yarn designed for the textile article, and for determining the position of the pattern in the fabric sample;

linear data generating means for generating a set of one-dimensional linear data from the two-dimensional image data, the linear data representing distances and lengths on the yarn and including position data defining the positions of the textures on the yarn;

yarn texture control data storage means for storing yarn texture control data representative of different sets of parameters of the texturing of the yarn in a yarn fabrication device;

a yarn fabricating device for fabricating the yarn and for changing the texture of the yarn according to the position data and the yarn texture control data; and a fabric forming device for forming the patterned textile article using the yarn fabricated by said yarn fabricating device.

7. The computer-assisted system as claimed in claim 6, wherein said yarn is a fancy yarn.

8. The computer-assisted system as claimed in claim 7, wherein said yarn fabricating device includes a yarn twisting mechanism, a feeding roller mechanism for feeding the yarn into said yarn twisting mechanism, and a delivery roller mechanism for delivering the yarn from said yarn twisting mechanism.

9. The computer-assisted system as claimed in claim 8, wherein said feeding and delivery roller mechanisms are variable in speed so as to change the texture of the yarn.

10. The computer-assisted system as claimed in claim 9, wherein the parameters of the texturing of the yarn are related to the speeds of said feeding and delivery roller machine.

* * * * *